US007426794B2

(12) United States Patent
Swensen

(10) Patent No.: US 7,426,794 B2
(45) Date of Patent: Sep. 23, 2008

(54) INSOLE SUPPORT SYSTEM

(76) Inventor: Robert John Swensen, 516 Sutter St., Jackson, CA (US) 95642

( * ) Notice: Subject to any disclaimer, the term of this patent is extended or adjusted under 35 U.S.C. 154(b) by 340 days.

(21) Appl. No.: 11/343,520

(22) Filed: Jan. 30, 2006

(65) Prior Publication Data

US 2006/0123663 A1 Jun. 15, 2006

Related U.S. Application Data

(63) Continuation-in-part of application No. 10/751,065, filed on Jan. 5, 2004, now abandoned.

(51) Int. Cl.
*A43B 13/38* (2006.01)

(52) U.S. Cl. ..... 36/43; 36/91; 36/92; 36/145; 36/166; 36/174

(58) Field of Classification Search ..... 36/43, 36/91, 92, 145, 166, 173, 174, 180
See application file for complete search history.

(56) References Cited

U.S. PATENT DOCUMENTS

| | | | | | |
|---|---|---|---|---|---|
| 2,081,474 | A * | 5/1937 | Burns | 36/174 |
| 2,421,088 | A * | 5/1947 | Sims | 36/174 |
| 3,084,695 | A * | 4/1963 | O'Donnell | 36/174 |
| 3,086,532 | A * | 4/1963 | Mistarz | 36/145 |
| 4,124,946 | A * | 11/1978 | Tomlin | 36/43 |
| 4,240,214 | A * | 12/1980 | Sigle et al. | 36/30 R |
| 4,677,766 | A * | 7/1987 | Gudas | 36/43 |
| 4,841,648 | A * | 6/1989 | Shaffer et al. | 36/43 |
| 5,551,173 | A | 9/1996 | Chambers | |
| 6,233,847 | B1 | 5/2001 | Brown | |
| 6,237,256 | B1 | 5/2001 | Maki et al. | |
| 6,253,469 | B1 * | 7/2001 | Atlani et al. | 36/174 |
| 6,408,543 | B1 | 6/2002 | Erickson et al. | |
| 6,474,003 | B2 | 11/2002 | Erickson et al. | |
| 6,510,626 | B1 * | 1/2003 | Greenawalt | 36/43 |
| 6,543,158 | B2 | 4/2003 | Dieckhaus | |
| 6,594,922 | B1 * | 7/2003 | Mansfield et al. | 36/145 |
| 2002/0056208 | A1 * | 5/2002 | Brown | 36/44 |

FOREIGN PATENT DOCUMENTS

JP 04276205 A * 10/1992

* cited by examiner

*Primary Examiner*—Marie Patterson
(74) *Attorney, Agent, or Firm*—R. Michael West

(57) ABSTRACT

A foot support insole having four different versions, each providing differing degrees of arch support for use in any shoe or boot. The insole is biomechanically shaped to support the medial arch, the lateral arch, the metatarsal arch, and the heel. In each of these versions, the principal variable is the extent of support for the medial arch. Low, medium, high, and extreme foot support versions are disclosed. The insole design effectively distributes the weight-generated forces provided by the user into a neutral plantigrade position. Supporting the neutral position for the foot obtains optimum balance and weight distribution by dispersing the forces applied by the foot over the greatest area possible within the shoe. The insole allows the three foot arches to work together and function as a structural support tripod, alternatively absorbing compressive forces and recoiling into a stable support state.

19 Claims, 4 Drawing Sheets

| INSOLE SIZE 1 | SHOE SIZE: WOMENS 5/6 | | | | | |
|---|---|---|---|---|---|---|
| SUPPORT | MEDIAL ARCH | | LATERAL ARCH | | HEEL CUP | METATARSAL ARCH |
| | LENGTH | HEIGHT | LENGTH | HEIGHT | LENGTH | HEIGHT |
| LOW | 100mm | 7.5mm | 80mm | 3.75mm | 45mm | 2mm |
| MEDIUM | 100mm | 15mm | 80mm | 7.5mm | 45mm | 2mm |
| HIGH | 100mm | 22.5mm | 80mm | 11.25mm | 45mm | 2mm |
| EXTREME | 100mm | 30mm | 80mm | 15mm | 45mm | 2mm |

*Fig. 13A*

| INSOLE SIZE 2 | SHOE SIZE: MENS 6/7 - WOMENS 7/8 | | | | | |
|---|---|---|---|---|---|---|
| SUPPORT | MEDIAL ARCH | | LATERAL ARCH | | HEEL CUP | METATARSAL ARCH |
| | LENGTH | HEIGHT | LENGTH | HEIGHT | LENGTH | HEIGHT |
| LOW | 105mm | 7.5mm | 85mm | 3.75mm | 45mm | 2mm |
| MEDIUM | 105mm | 15mm | 85mm | 7.5mm | 45mm | 2mm |
| HIGH | 105mm | 22.5mm | 85mm | 11.25mm | 45mm | 2mm |
| EXTREME | 105mm | 30mm | 85mm | 15mm | 45mm | 2mm |

*Fig. 13B*

| INSOLE SIZE 3 | SHOE SIZE: MENS 8/9 - WOMENS 9/10 | | | | | |
|---|---|---|---|---|---|---|
| SUPPORT | MEDIAL ARCH | | LATERAL ARCH | | HEEL CUP | METATARSAL ARCH |
| | LENGTH | HEIGHT | LENGTH | HEIGHT | LENGTH | HEIGHT |
| LOW | 110mm | 7.5mm | 90mm | 3.75mm | 50mm | 2mm |
| MEDIUM | 110mm | 15mm | 90mm | 7.5mm | 50mm | 2mm |
| HIGH | 110mm | 22.5mm | 90mm | 11.25mm | 50mm | 2mm |
| EXTREME | 110mm | 30mm | 90mm | 15mm | 50mm | 2mm |

*Fig. 13C*

| INSOLE SIZE 4 | SHOE SIZE: MENS 10/11- WOMENS 11/12 | | | | | |
|---|---|---|---|---|---|---|
| SUPPORT | MEDIAL ARCH | | LATERAL ARCH | | HEEL CUP | METATARSAL ARCH |
| | LENGTH | HEIGHT | LENGTH | HEIGHT | LENGTH | HEIGHT |
| LOW | 120mm | 7.5mm | 100mm | 3.75mm | 50mm | 3mm |
| MEDIUM | 120mm | 15mm | 100mm | 7.5mm | 50mm | 3mm |
| HIGH | 120mm | 22.5mm | 100mm | 11.25mm | 50mm | 3mm |
| EXTREME | 120mm | 30mm | 100mm | 15mm | 50mm | 3mm |

*Fig. 13D*

| INSOLE SIZE 5 | SHOE SIZE: MENS 12/13 | | | | | |
|---|---|---|---|---|---|---|
| SUPPORT | MEDIAL ARCH | | LATERAL ARCH | | HEEL CUP | METATARSAL ARCH |
| | LENGTH | HEIGHT | LENGTH | HEIGHT | LENGTH | HEIGHT |
| LOW | 130mm | 7.5mm | 110mm | 3.75mm | 55mm | 3mm |
| MEDIUM | 130mm | 15mm | 110mm | 7.5mm | 55mm | 3mm |
| HIGH | 130mm | 22.5mm | 110mm | 11.25mm | 55mm | 3mm |
| EXTREME | 130mm | 30mm | 110mm | 15mm | 55mm | 3mm |

*Fig. 13E*

| INSOLE SIZE 6 | SHOE SIZE: MENS 14/15 | | | | | |
|---|---|---|---|---|---|---|
| SUPPORT | MEDIAL ARCH | | LATERAL ARCH | | HEEL CUP | METATARSAL ARCH |
| | LENGTH | HEIGHT | LENGTH | HEIGHT | LENGTH | HEIGHT |
| LOW | 150mm | 7.5mm | 120mm | 3.75mm | 55mm | 3mm |
| MEDIUM | 150mm | 15mm | 120mm | 7.5mm | 55mm | 3mm |
| HIGH | 150mm | 22.5mm | 120mm | 11.25mm | 55mm | 3mm |
| EXTREME | 150mm | 30mm | 120mm | 15mm | 55mm | 3mm |

*Fig. 13F*

INSOLE SUPPORT SYSTEM

CROSS-REFERENCE TO A RELATED APPLICATION

This application is a Continuation-In-Part of application Ser. No. 10/751,065, filed Jan. 5, 2004 now abandoned.

BACKGROUND OF THE INVENTION

1. Field of the Invention

The invention relates generally to insoles which may be inserted into shoes or boots to provide enhanced foot support and comfort. More particularly, the invention pertains to an insole support system in which arch support is provided in the medial, lateral, and metatarsal regions of the foot, and lateral and rear support is provided in the heel region of the foot. Four different insole designs are disclosed, each sharing common structural features but displaying varying degrees of support in the medial arch region to accommodate a range of different degrees of medial arches.

2. Description of the Prior Art

In structure and function, the foot is one of the most complex features of the human anatomy. It consists of twenty-six bones, thirty-three joints, one hundred and twelve ligaments, three arches, four layers of tissue on the sole of the foot, and twenty intrinsic muscles. As those involved in sports or challenging physical activity can attest, the ligaments in the foot are the most likely to be the subject of painful sprains. In order effectively to eliminate foot and leg ailments, solid support and in some cases corrective positioning of the three foot arches are required.

The three foot arches, including the medial arch, the lateral arch, and the metatarsal arch, are upwardly extending arcuate portions of the foot which form voids in the foot bed. Unless a person is flat footed, these voids exist to varying degrees in each person's feet, thereby requiring a different extent of support to fill the voids properly. A firm, yet resilient support, including corrective positioning for the foot arches, is required to help distribute weight and foot motion more evenly across the foot bed. It is well recognized that proper support for a person's feet will provide enhanced comfort and health throughout the entire body.

While it is commonly believed that the insole with the most cushion and softness is the best, such insoles have proven less than ideal in several aspects. The open-cell foam material from which most insoles are made lacks the strength and firmness to provide the necessary foot support. Thus, inexpensive and low quality cushioning insoles only offer temporary relief rather than a long-term solution for foot discomfort.

On the opposite end of spectrum from the very soft foam insoles, are custom orthopedic supports made by podiatrists particularly for individual patients. These orthopedic supports are typically made from a hard, inflexible, thermal plastic material. In structure, they are shorter in length than the patient's entire foot, provide a hard heel support area and a high medial arch area. However, they do not extend past the forward metatarsal area, and offer little to no lateral support for equalizing balance. Since they are custom made, orthopedic supports are quite expensive, and can only be afforded by a small percentage of the population which needs proper foot support. Moreover, owing to the hard and rigid nature of the plastic material from which they are made, orthopedic supports are not suitable for use by most athletes.

Thus, it is an object of the present invention to provide a weight-bearing insole support system made from a resilient and semi-rigid material that will provide more support than the soft foam insole yet be more comfortable and have more flexibility than the hard plastic orthopedic supports. It is also an object to provide an insole having raised configurations which support all three arches in the human foot, and a recessed configuration which provides a deep cup for heel support. It is another object herein to disclose plural insole designs which share common features, while providing varying degrees of medial arch support which are well suited to accommodate the majority of foot arch voids. Lastly, since the insole system described herein is made from a resilient yet semi-rigid material, controlled movement of the subtalar joint is allowed and balanced shock-absorption for the entire foot is provided.

SUMMARY OF THE INVENTION

A foot support insole is disclosed comprising an elongated, resilient, and semi-flexible body. The body has a size and a plan configuration which generally conform to the size and general shape of the foot of the user. The rearward portion of the body includes a relatively depressed heel cup. The heel cup is defined by a floor surrounded by a raised wall extending continuously around the lateral and rear sides of the floor. The wall is contoured to provide lateral and rear support for the foot heel.

The body also includes a metatarsal arch, or raised feature, located in its forward portion. The metatarsal arch has a relatively wide front section and a relatively narrow rear section. Between the metatarsal arch and the heel cup is a longitudinal medial arch, also providing a raised feature. The medial arch is more specifically located on an inner, medial portion of the body. Generally opposing the medial arch on the body is a longitudinal lateral arch. This raised feature is located on an outer, lateral portion of the body, extending from the raised wall of the heel cup forwardly past the rear section of the metatarsal arch.

As disclosed herein, this basic insole construction may be adapted to suit a wide variety of foot sizes and shapes. There are hundreds of different foot shapes among the human species and all include the same basic structural and operational features. However, the area of each foot that varies considerably from person to person is the medial arch, also called the dynamic arch. The medial arch flexes downward to transfer weight to a support surface. It also springs back up, to return forces to the lower limbs of the person, while walking. The principal characteristics of this arch are its elasticity and the considerable number of small joints between its component parts. When these factors are taken into account, especially for a person with a particularly high medial arch, it can be appreciated that adequate support of the medial arch is critical to foot comfort and well-being.

It is for this reason that the primary focus and design considerations for the present invention revolve around the medial arch. The foot support insole herein is preferably constructed in four different degrees of medial arch support. These four different degrees of support satisfy arch support requirements for the vast majority of feet, and eliminate the need for expensive custom orthopedic supports in most instances. By selecting the foot support insole having the proper degree of medial arch support for their feet, the user will enjoy maximum support with even distribution of body weight over the foot.

A lateral arch support is also provided. The lateral arch is longitudinal in configuration, and is located on the outer, lateral portion of the foot support insole, on the opposite side of the insole from the medial arch. The lateral arch is formed from an outer support wall, and has a standard degree of height which corresponds approximately to one-half the height of the medial arch. The length of the lateral arch also increases with increased shoe size for the support insole. The purposes of the lateral arch are to control supination (an outward turning of the foot) of the foot, to control unwanted foot motion or shifting within the shoe, and to provide equal lateral balance for the foot.

A metatarsal arch, having a section which is transverse to the longitudinal axis of the foot support insole, is also included. The raised extent of the metatarsal arch is somewhat circular or tear-drop shaped in configuration, providing support for the foot by distributing pressure more evenly on the forefoot and toes. The metatarsal arch has the characteristics of a "hemi-arch" or half dome which has a portion directed downwardly and rearwardly toward the medial arch. Thus, when the medial borders of the feet are placed in apposition to the foot metatarsal, a complete tarsal dome is formed. With the inclusion of this metatarsal arch in the foot support insole, body weight will be distributed more evenly over the metatarsal bones of the forefoot. It is a physiological fact that the metatarsal arch does not vary in degree from person to person as much as the medial arch. Thus, the foot support insole of the present invention employs a height for the metatarsal arch which varies only slightly, for varying degrees of medial arch and for varying shoe sizes for the insoles.

The heel portion of the foot is an extremely important part of the foot that is normally overlooked in most supportive insoles. Because the bottom of the foot heel resembles the curvature of a tennis ball, it is not difficult to visualize that an unsupported foot heel will tend to move and roll from side to side within a shoe. In addition, the bottom of the heel will have more of a high pressure, point contact with the shoe, since certain bottom and lateral portions are unsupported. Consequently, the foot support insole disclosed herein includes a weight-bearing deep heel cup. The heel cup includes a continuous wall, extending from one side, around the rear side, and ending on the opposite side. The wall includes a downwardly and inwardly inclined contoured portion extending to the floor of the cup. This contoured portion is configured to accommodate the curved portion of the heel snugly and comfortably.

The foot support insole is readily manufactured in standard shoe sizes. As will be discussed in more detail below, the primary variables for insoles of different shoe sizes are the length and the width of the insole, the length of the medial arch, and the length of the lateral arch.

A foot support insole of the proper size and providing the proper degree of medial arch support is inserted into the interior of any shoe or boot and adjusted to lie flat on the floor. Then, the user's foot is inserted into the shoe or boot, to lie over the support insole. Owing to the three raised features in the body, at the locations of the medial arch, the lateral arch, and the metatarsal arch, these foot arches are fully supported. The depressed heel cup supports the heel, and helps to restrain lateral and longitudinal movements of the foot. The weight of the user is thereby distributed more evenly across the user's foot bed and unwanted movement and rolling of the foot is inhibited.

BRIEF DESCRIPTION OF THE DRAWINGS

FIG. 13A is a chart depicting dimensional aspects of the shoe insole for women's shoe size 5/6;

FIG. 13B is a chart depicting dimensional aspects of the shoe insole for men's shoe sizes 6/7 and women's shoe sizes 7/8;

FIG. 13C is a chart depicting dimensional aspects of the shoe insole for men's shoe sizes 8/9 and women's shoe sizes 9/10;

FIG. 13D is a chart depicting dimensional aspects of the shoe insole for men's shoe sizes 10/11 and women's shoe sizes 11/12;

FIG. 13E is a chart depicting dimensional aspects of the shoe insole for men's shoe sizes 12/13;

FIG. 13F is a chart depicting dimensional aspects of the shoe insole for men's shoe sizes 14/15;

DETAILED DESCRIPTION OF THE PREFERRED EMBODIMENT

Figure 1:
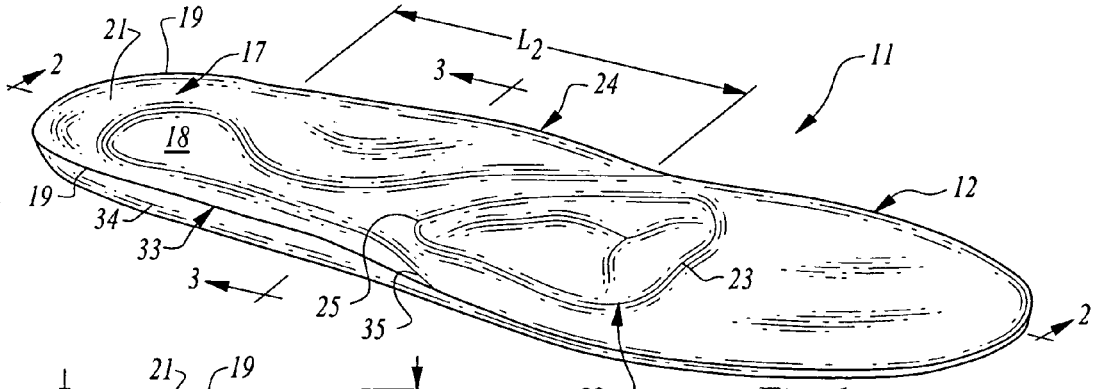
FIG. 1 is a right front perspective view of the shoe insole of the present invention constructed to accommodate a person having a low degree of medial arch.
Figure 3:
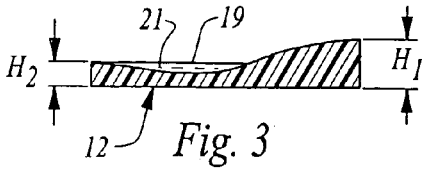
FIG. 3 is a transverse, cross-sectional view taken on the line 3-3 in FIG. 1.
Figure 2:
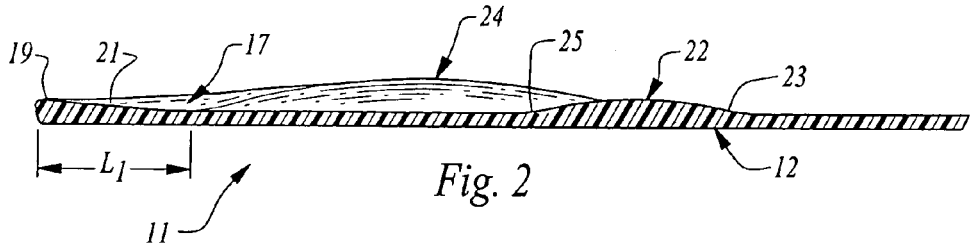
FIG. 2 is a longitudinal, cross-sectional view taken on the line 2-2 in FIG. 1.

Making particular reference to FIGS. 1-3, the foot support insole 11 of the present invention comprises an elongated body 12, preferably manufactured from a resilient and semi-flexible material, such as polyurethane. However, other materials, such as polypropylene, polyethylene, and ethyl vinyl acetate which have been formulated to have similar resiliency and flexibility characteristics as polyurethane may be substituted. These resiliency and flexibility characteristics would make a suitable material more supportive and less flexible than the open cell foam used in inexpensive insoles, and more resilient and more flexible than the hard plastic used in expensive custom orthotic supports.

Another measure of suitable material characteristics is how the material rates on the durometer scale. The durometer scale generally runs from a lower number of 18 for a very soft material, to an upper number of 70 for a very hard material. It is preferable that the material used to make body 12 be within the range of 20 to 50 on this scale.

The size and plan configuration of body 12 generally conform to the length, width, and peripheral configuration of the user's foot. As will be disclosed further herein, the insole 11 may be manufactured to satisfy all of the standard shoe sizes, and dimensional information for shoe sizes ranging from women's size 5/6 up to men's sizes 14/15 is provided in chart form, in FIGS. 13A-13F, inclusive.

Figure 4:
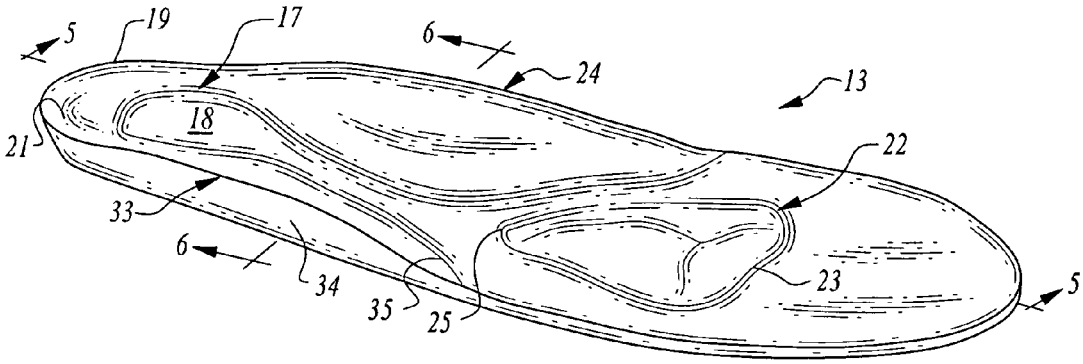
FIG. 4 is a right front perspective view of a shoe insole constructed to accommodate a person having a medium degree of medial arch.
Figure 6:
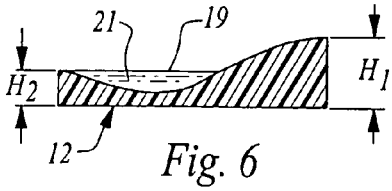
FIG. 6 is a transverse, cross-sectional view taken on the line 6-6 in FIG. 4.
Figure 5:
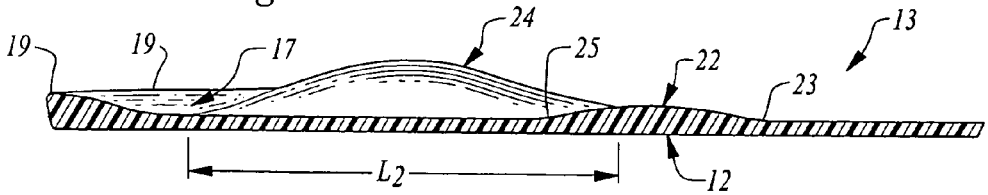
FIG. 5 is a longitudinal, cross-sectional view taken on the line 5-5 in FIG. 4.
Figure 7:
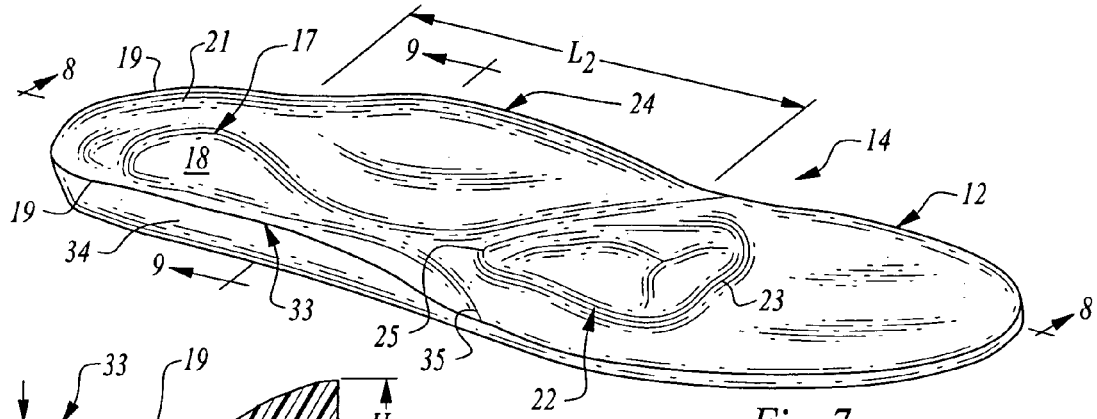
FIG. 7 is a right front perspective view of a shoe insole constructed to accommodate a person having a high degree of medial arch.
Figure 9:
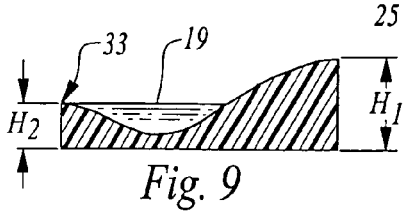
FIG. 9 is a transverse, cross-sectional view taken on the line 9-9 in FIG. 7.
Figure 8:
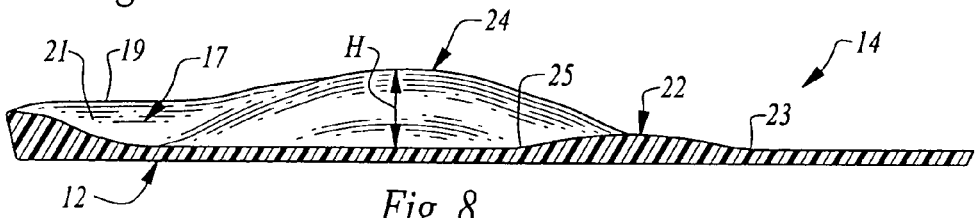
FIG. 8 is a longitudinal, cross-sectional view taken on the line 8-8 in FIG. 7.
Figure 10:
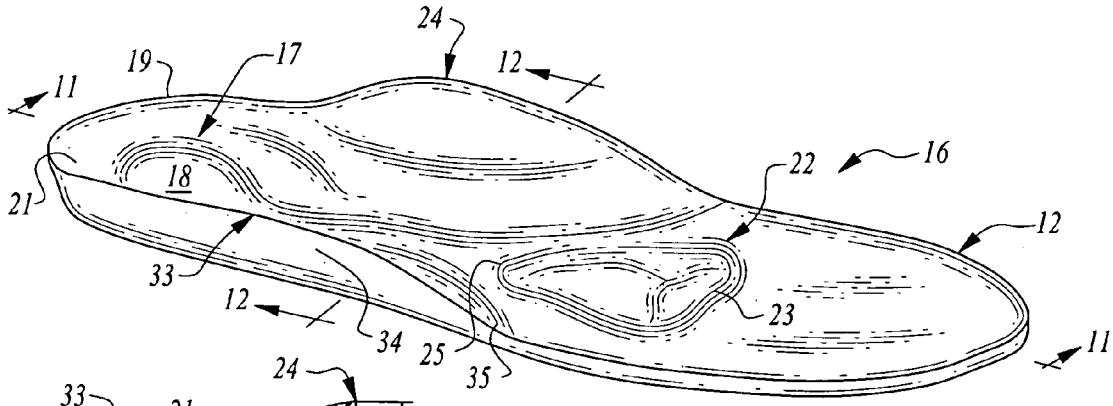
FIG. 10 is a right front perspective view of a shoe insole constructed to accommodate a person having an extreme degree of medial arch.
Figure 12:
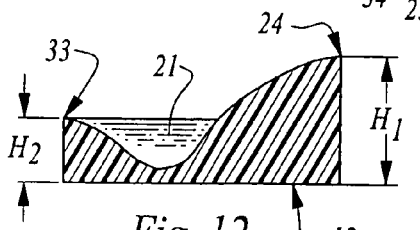
FIG. 12 is a transverse, cross-sectional view taken on the line 12-12 in FIG. 10.
Figure 11:
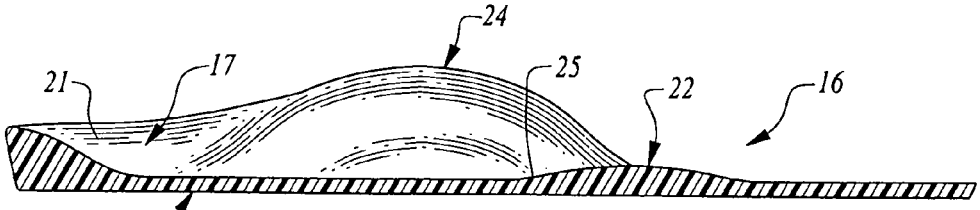
FIG. 11 is a longitudinal, cross-sectional view taken on the line 11-11 in FIG. 10.
Figure 14A:
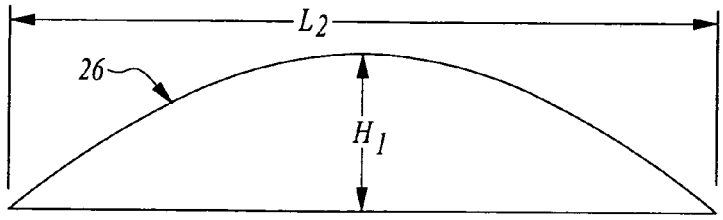
FIG. 14A is a side profile view of the high degree medial arch, based upon the dimensions shown in FIG. 13A.
Figure 14B:
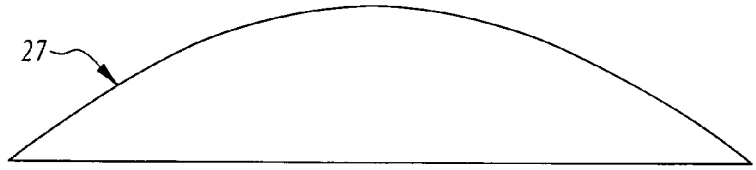
FIG. 14B is a side profile view of the high degree medial arch, based upon the dimensions shown in FIG. 13B.
Figure 14C:
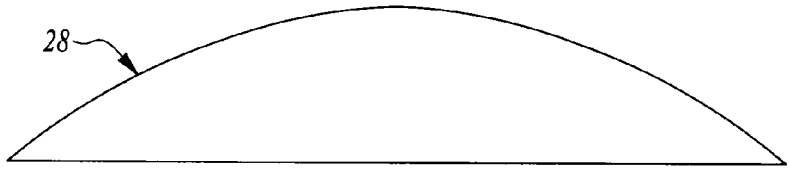
FIG. 14C is a side profile view of the high degree medial arch, based upon the dimensions shown in FIG. 13C.
Figure 14D:
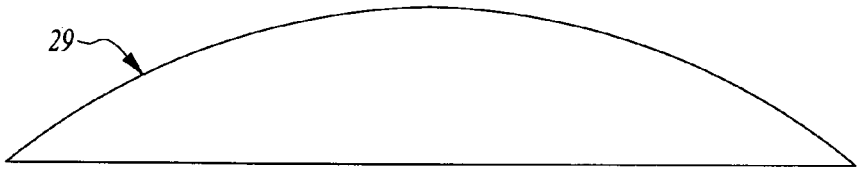
FIG. 14D is a side profile view of the high degree medial arch, based upon the dimensions shown in FIG. 13D.
Figure 14E:
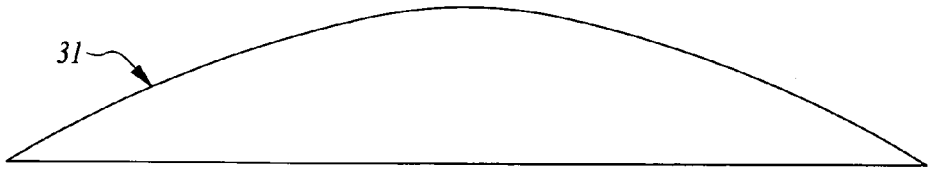
FIG. 14E is a side profile view of the high degree medial arch, based upon the dimensions shown in FIG. 13E; and, FIG. 14F is a side profile view of the high degree medial arch, based upon the dimensions shown in FIG. 13F.
Figure 14F:
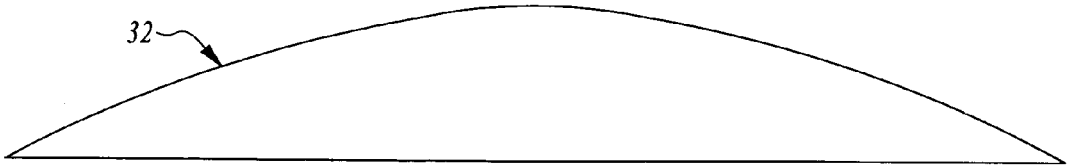

The insole of the present invention is also intended to be manufactured in four different versions, each providing a different degree of foot support. Insole 11, for example, would be characterized as a low degree support version, because its contour has the least amount of arch support in certain critical areas. Insole 13 shown in FIGS. 4-6, provides medium support. Insole 14 shown in FIGS. 7-9, provides high support. And, insole 16 shown in FIGS. 10-12, provides extreme support. These four insole constructions will provide proper foot support for the majority of users without requiring custom fitting or custom manufacturing for the insoles. Each of the constructions shares common features, although the dimensional extent of certain of those features changes with different sizes and with different degrees of the foot support required. Thus, where appropriate, the same numerical identifications will be used for those structural features which are shared among the four different insole versions described herein.

For example, each of the insole designs employ a deep heel cup 17, located in the rearward portion of elongated body 12. Heel cup 17 includes a floor 18 surrounded by a raised wall 19 extending continuously around the lateral and rear sides of the heel cup floor. The wall 19 has an inwardly and downwardly directed contour 21 which extends to floor 18. The length L, of heel cup 17 extends from the rearmost portion of the raised wall 19 to the forward end of the floor 18. $L_1$ varies from 45 mm for a women's shoe size 5/6 (insole size 1) to 55 mm for a man's shoe size 14/15 (insole size 6). Dimensional information for the various arch and heel features for a number of standard shoe sizes are set forth in the tables depicted in FIGS. 13A-13F. Contour 21 and wall 19 provide inner lateral, outer lateral, and rear support for the foot heel of the user, and act to restrain or confine movement of the heel within a shoe or boot.

A metatarsal arch 22 is located in the forward portion of the body 12, and has a relatively wide front section 23 which is transverse to the body 12. Transverse section 23 is located adjacent the region where the toes connect to the main body of the foot. As shown in FIGS. 7-8 and FIGS. 10-11, arch 22 tapers downwardly and rearwardly from its highest point to a relatively narrow rear section 25. The metatarsal arch 22 varies little in height, from size to size, with women's shoe size 5/6 having a metatarsal arch 2 mm in height, and a man's shoe size 14/15 having a metatarsal arch 3 mm in height. Arch 22 in combination with transverse section 23 acts to distribute pressures more evenly on the forefoot and the toes of the user.

A medial arch 24 is located on the inner, medial portion of the body 12, between the heel cup 17 and the metatarsal arch 22. Longitudinal in configuration, medial arch 24 has a length $L_2$ and a height $H_1$. Length $L_2$ is determined primarily by the insole size pertaining to a particular shoe size. As shown in FIG. 13A through 13F, Length $L_2$ varies from approximately 100 mm for a women's shoe size 5/6 (insole size 1) to approximately 150 mm for a man's shoe size 14/15 (insole size 6).

The height $H_1$ of the medial arch 22 is determined by the degree of support to be provided by the foot support insole. By making an ink or other impression of a person's foot on a planar surface, a visual assessment can be made whether the person has a flat foot, or requires some degree of arch support. If the person is flat footed, then very little or no arch support is required as the person's foot bed will naturally engage all of the support surface within the shoe. But if a medial arch is present, it may be classified conveniently as a low, medium, high, or extreme arch.

The height $H_1$ is the same for all the insole sizes, and varies solely upon the amount of required arch support. FIGS. 13A through 13F show that while the length $L_2$ varies with shoe size, height $H_1$ does not. A low degree of medial arch support requires a height of approximately 7.5 mm for the medial arch 22; a medium degree of support requires a height of approximately 15 mm for the medial arch 22; a high degree of support requires a height of approximately 22.5 mm for the medial arch 22; and an extreme degree of support requires a height of approximately 30 mm for the medial arch 22.

The relationship that shoe size has upon the profile of the medial arch for a given degree of arch support, is evident in FIGS. 14A through 14F. These Figures are representative for the shape of a medial arch providing a high degree of support, for the various sizes of insole contemplated herein. Profile 26 corresponds to the appearance of the medial arch for an insole for women's shoe size 5/6; profile 27 corresponds to the appearance of the medial arch for an insole for man's shoe size 6/7 and women's shoe size 7/8; profile 28 corresponds to the appearance of the medial arch for an insole for man's shoe size 8/9 and women's shoe size 9/10; profile 29 corresponds to the appearance of the medial arch for an insole for man's shoe size 10/11 and women's shoe size 11/12; profile 31 corresponds to the appearance of the medial arch for an insole for man's shoe size 12/13; and profile 32 corresponds to the appearance of the medial arch for an insole for man's shoe size 14/15. It will be appreciated that for a given height $H_1$, as the length $L_2$ increases with increasing insole size, the gradient for the arch decreases.

A lateral arch 33 is also provided. Lateral arch 33 extends longitudinally along the outer, lateral portion of the body 12. Lateral arch 33 is positioned on the opposite side of the insole from the medial arch 24, and extends from the raised wall 19 of the heel cup to a forward end 35. As is evident particularly in FIGS. 1, 4, 7, and 10, the length of arch 33 is such that forward end 35 terminates on the body 12 in a position which is forward from the rear section 25 of the metatarsal arch 22. The lateral arch is formed from an outer support wall 34, and has a standard degree of height $H_2$ which corresponds approximately to one-half the height $H_1$ of the medial arch 24. The height $H_2$ ranges from a low value of approximately 3.75 mm to a high value of 15 mm, as shown in the charts of FIG. 13A through 13F. These charts also show that the length of the lateral arch 33 also increases with increased show size for the support insole, ranging from 80 mm for the smallest size insole to 120 mm for the largest size insole. One of the purposes of the lateral arch 33 is to control supination, an outward turning or rolling over of the foot. The lateral arch 33 also controls unwanted foot motion or shifting within the shoe, and provides equal lateral balance for the foot.

It will be appreciated, then, that I have disclosed an insole support system in which arch support is provided in the medial, lateral, and metatarsal regions of the foot, and lateral and rear support is provided in the heel region of the foot. Four different insole designs have been taught, each sharing common structural features but displaying varying degrees of support in the medial arch region to accommodate a range of different degrees of medial arches.

What is claimed is:

1. A foot support insole comprising:

a. an elongated, resilient body, having a size and plan configuration generally conforming to the foot of a person;

b. a heel cup in a rearward portion of said body, said heel cup having a floor surrounded by a raised wall extending continuously around lateral and rear sides of said floor, said wall being contoured to provide lateral and rear support for the foot heel;

c. a metatarsal arch located in a forward portion of said body, said metatarsal arch having a front section and a rear section;

d. a longitudinal medial arch located on an inner, medial portion of said body, intermediate said heel cup and said metatarsal arch; and, e. a longitudinal lateral arch located on an outer, lateral portion of said body, said lateral arch having a support wall extending from said raised wall of said heel cup to a forward end, said forward end terminating on said body in a position which is forward from said rear section of said metatarsal arch.

2. A foot support insole as in claim 1 in which said medial arch has a length and a height, and in which said length is determined by the person's shoe size and said height is determined by the degree of medial arch in the person's foot.

3. A foot support insole as in claim 2 in which said length of said medial arch varies from approximately 100 mm to 150 mm and in which said height of said medial arch varies from approximately 7.5 mm to 30 mm.

4. A foot support insole as in claim 1 in which said lateral arch has a length and a height, and in which said length is determined by the person's shoe size and said height is determined by the degree of medial arch in the person's foot.

5. A foot support insole as in claim 4 in which said length of said lateral arch varies from approximately 80 mm to 120 mm and in which said height of said lateral arch varies from approximately 3.75 mm to 15 mm.

6. A foot support insole as in claim 1 in which said heel cup has a length, and in which said length of said heel cup is determined by the person's shoe size.

7. A foot support insole as in claim 6 in which said length of said heel cup varies from approximately 45 mm to 55 mm.

8. A foot support insole as in claim 1 in which said metatarsal arch has a height, and in which said height of said metatarsal arch is determined by the person's shoe size.

9. A foot support insole as in claim 8 in which said height of said metatarsal arch varies from approximately 2 mm to 3 mm.

10. A foot support insole comprising:

a. an elongated, resilient body, having a size and plan configuration generally conforming to the foot of a person;

b. heel cup in a rearward portion of said body, said heel cup having a floor surrounded by a raised wall extending continuously around lateral and rear sides of said floor;

c. a metatarsal arch located in a forward portion of said body, said arch extending in length from a front section to a rear section and being elevated in height a sufficient amount to provide support for the metatarsal region of the foot;

d. a longitudinal medial arch located on an inner, medial portion of said body, intermediate said heel cup and said metatarsal arch, said medial arch extending in length and being elevated in height a sufficient amount to provide support for the medial portion of the foot; and, e. a longitudinal lateral arch located on an outer, lateral portion of said body, said lateral arch having a support wall extending from said raised wall of said heel cup to a forward end, said forward end terminating on said body in a position which is forward from said rear section of said metatarsal arch, said lateral arch being elevated in height a sufficient amount to provide support for the lateral portion of the foot.

11. A foot support insole as in claim 10 in which said length of said medial arch is determined by the person's shoe size and said height is determined by the degree of medial arch in the person's foot.

12. A foot support insole as in claim 11 in which said length of said medial arch varies from approximately 100 mm to 150 mm and in which said height of said medial arch varies from approximately 7.5 mm to 30 mm.

13. A foot support insole as in claim 10 in which said length of said lateral arch is determined by the person's shoe size and said height of said lateral arch is determined by the degree of medial arch in the person's foot.

14. A foot support insole as in claim 13 in which said length of said lateral arch varies from approximately 80 mm to 120 mm and in which said height of said lateral arch varies from approximately 3.75 mm to 15 mm.

15. A foot support insole as in claim 10 in which said heel cup has a length, and in which said length of said heel cup is determined by the person's shoe size.

16. A foot support insole as in claim 15 in which said length of said heel cup varies from approximately 45 mm to 55 mm.

17. A foot support insole as in claim 10 in which said metatarsal arch has a height, and in which said height of said metatarsal arch is determined by the person's shoe size.

18. A foot support insole as in claim 17 in which said height of said metatarsal arch varies from approximately 2 mm to 3 mm.

19. A foot support insole comprising:

a. an elongated, resilient body, having a size and plan configuration generally conforming to the foot of a person;

b. a heel cup in a rearward portion of said body, said heel cup having a floor surrounded by a raised wall extending continuously around lateral and rear sides of said floor and having a length varying from approximately 45 mm to 55 mm;

c. a metatarsal arch located in a forward portion of said body, said arch having a height varying from approximately 2 mm to 3 mm and having a length extending from a front section to a rear section;

d. a longitudinal medial arch located on an inner, medial portion of said body, intermediate said heel cup and said metatarsal arch, said medial arch having a length varying from approximately 100 mm to 150 mm, and having a height varying from 7.5 mm to 30 mm; and, e. a longitudinal lateral arch located on an outer, lateral portion of said body, said lateral arch having a support wall extending from said raised wall of said heel cup to a forward end, said forward end terminating on said body in a position which is forward from said rear section of said metatarsal arch, said lateral arch having a length varying from approximately 80 mm to 120 mm, and having a height varying from approximately 3.75 mm to 15 mm.

* * * * *